United States Patent [19]

Kondo et al.

[11] 4,283,613

[45] Aug. 11, 1981

[54] CONSTRUCTION FOR ATTACHING KNOB TO MANIPULATION ROD OF PUSH-BUTTON TYPE MECHANISM

[75] Inventors: Shiro Kondo; Minoru Oyama, both of Furukawa, Japan

[73] Assignee: Alps Electric Co., Ltd., Tokyo, Japan

[21] Appl. No.: 139,728

[22] Filed: Apr. 14, 1980

[30] Foreign Application Priority Data

Apr. 19, 1979 [JP] Japan ..... 54/52300[U]

[51] Int. Cl.[3] ..... H01H 3/12

[52] U.S. Cl. ..... 200/340; 200/333

[58] Field of Search ..... 200/340, 333, 159 R; 74/483 PB; 16/121

[56] References Cited

U.S. PATENT DOCUMENTS

| | | | |
|---|---|---|---|
| 1,815,596 | 7/1931 | Stark | 16/118 |
| 2,230,916 | 2/1941 | Tinnerman | 85/36 |
| 2,301,169 | 11/1942 | Engstrom | 287/53 |
| 2,706,774 | 4/1955 | Bowman | 250/16 |
| 3,361,174 | 1/1968 | Bedford, Jr. | 151/7 |
| 3,386,127 | 6/1968 | Hitzeroth et al. | 16/121 |
| 3,428,344 | 7/1969 | Strange | 16/121 |
| 3,561,287 | 2/1971 | Lawrence, Jr. | 16/121 |
| 3,736,397 | 5/1973 | Pedersen | 200/340 |
| 3,810,052 | 5/1974 | Yanaga | 335/205 |
| 3,863,182 | 1/1975 | Lapointe | 335/207 |
| 3,906,222 | 9/1975 | Astier et al. | 250/229 |
| 3,996,805 | 12/1976 | Clark | 200/340 |

FOREIGN PATENT DOCUMENTS

| | | | |
|---|---|---|---|
| 266970 | 12/1968 | Austria | 200/340 |
| 961599 | 5/1950 | Fed. Rep. of Germany | 16/121 |
| 823415 | 12/1951 | Fed. Rep. of Germany | 16/121 |
| 1534913 | 3/1967 | Fed. Rep. of Germany | 16/121 |
| 1558875 | 1/1969 | France | 200/340 |

*Primary Examiner*—Willis Little

*Attorney, Agent, or Firm*—Guy W. Shoup; Gerard F. Dunne

[57] ABSTRACT

A construction for attaching a knob to a manipulation rod of a push-button type actuating mechanism. The knob has a cap-like shape with an outer wall and an inner cylinder having a bore. A snapping protrusion is formed at the lower end of the inner peripheral surface of the outer wall. The snapping protrusion has a tapered section protruding inwardly from the inner peripheral surface of the outer wall and a snapping step formed on the inner peripheral surface of the outer wall. The manipulating rod has a flange formed at its intermediate portion and resilient tongues formed on the upper end thereof. As the rod in inserted into the bore of the inner cylinder of the knob, the outer peripheral surface of the flange slides along the tapered section of the snapping protrusion spreading the outer wall outwardly and then comes into snapping engagement with the snapping step. This engagement is maintained firmly by the action of the resilient tongues which resiliently presses the rod downwardly to keep the flange in tight contact with the snapping step.

3 Claims, 9 Drawing Figures

CONSTRUCTION FOR ATTACHING KNOB TO MANIPULATION ROD OF PUSH-BUTTON TYPE MECHANISM

BACKGROUND OF THE INVENTION

The present invention relates to a construction for attaching a knob to a manipulation rod of a push-button type mechanism.

In the push-button type actuating mechanism such as that for push-button switch, a knob made of synthetic resin is fixedly secured to a outer end of a manipulation rod.

Referring to FIG. 1 showing a construction for connection between the manipulating rod and the knob, reference numeral 1' denotes a known switch body having contacts which are adapted to be switched by vertical movement of a manipulation rod 2'. The manipulation rod 2' is provided at its intermediate portion with a flange 2a' and, at its end, with a fitting recess 2b'. Reference numeral 3' denotes a compression spring acting between the switch body 1' and the flange 2a'.

A knob 4' made of a synthetic resin is provided therein with a fitting projection 4b'. The knob 4' is provided with an attaching portion 4a' on the inside of which is formed a fitting projection 4b'. The knob 4' is attached to the manipulation rod 2' with the attaching portion 4a' receiving the end of the manipulation rod 2' and the fitting projection 4b' engaging the fitting recess 2b'.

The above-mentioned knob 4' is formed in a manner described hereinunder. Referring to FIG. 2A, a mold cavity defined between the upper mold 5' and a lower mold 6' is filled with a synthetic resin injected thereinto. Then, as shown in FIG. 2B, the lower mold 6' is withdrawn as shown in FIG. 2B in the direction of the arrow to separate the upper and lower molds 5', 6' from each other and, as shown in FIG. 2C, the knob 4' attached to the lower mold 6' is pushed by knock-out pins 7' to be thus separated from the lower mold 6'. In separating the knob 4' from the lower mold 6', it is often experienced that the recess 6a' fittingly receiving the fitting projection 4b' undesirably cuts the latter. For this reason, it is difficult to obtain a shape and size of the fitting projection 4b strictly meeting the shape and size of the design. Namely, the variance in the size tends to occur due to a change in molding conditions, the batch of the plastic material and so forth.

It is, therefore, extremely difficult to ensure the strength of the knob 4' against the force which acts to withdraw the knob 4' from the manipulation rod 2', if the knob 4' formed by the above-explained process is snap-fitted onto the manipulation rod 2'. In an extreme case, play occurs between the knob and the rod of the switch due to the above-explained reason. This considerably deteriorates the commercial value of the products. Since the knob 4' generally has a small size, if the above-mentioned force against the withdrawal is increased by increasing the size of the fitting projection solely, the insertion force is undersirably increased possibly resulting in bending of the manipulating rod during the assembly operation.

SUMMARY OF THE INVENTION

It is, therefore, an object of the invention to provide a construction which permits easy attaching of the knob to the manipulation rod of a push-button actuating mechanism.

It is another object of the invention to provide an attaching construction capable of ensuring firm connection between the knob and the manipulating rod.

It is still another object of the invention to provide an attaching construction which can eliminate a change in connecting conditions after the attachment operation.

These and other objects, as well as advantageous features of the invention will become clear from the following description of the present invention taken in conjunction with the accompanying drawings.

DESCRIPTION OF THE PREFERRED EMBODIMENT

A preferred embodiment of the invention will be described hereinunder with reference to the accompanying drawings.

Figure 1:
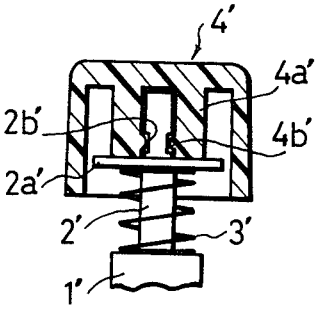
Fig.1 PRIOR ART
FIG. 1 is a sectional side elevational view of a conventional construction for attaching a knob to a manipulating rod.
Figure 2:
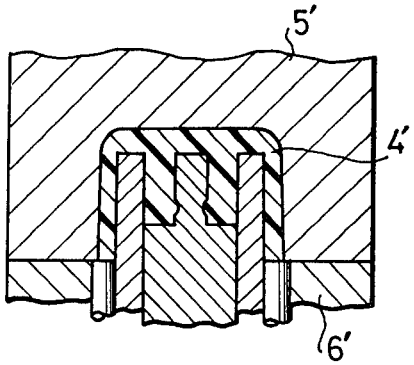
Fig.2 (A) PRIOR ART
FIG. 2A is a sectional view of an apparatus for forming the knob as shown in FIG. 1, showing a mold cavity filled with a synthetic resin.
FIG. 2B is a sectional view of the apparatus shown in FIG. 2A with the lower mold being lowered.
FIG. 2C is a sectional view of the apparatus shown in FIG. 2 in the state in which the knob attaching to the lower mold is being separated from the latter.
Figure 2:
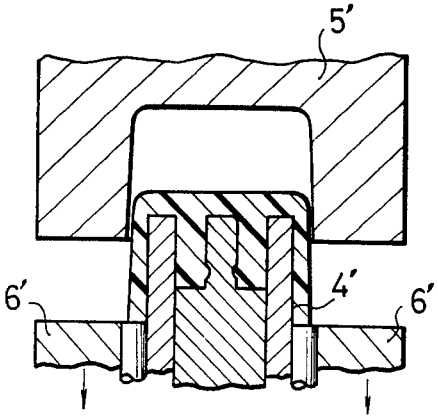
Fig.2 (B) PRIOR ART
Figure 2:
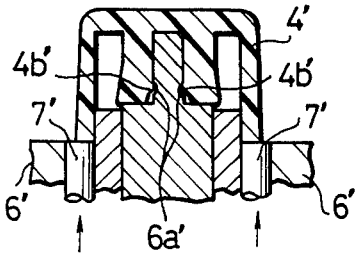
Fig.2 (C) PRIOR ART
Figure 3:
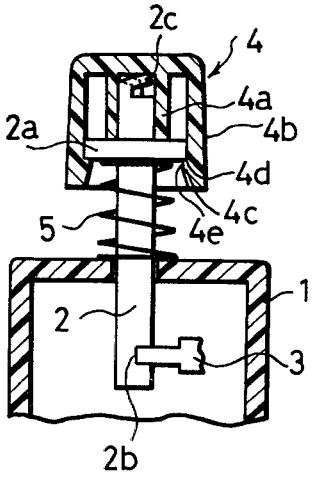
FIG. 3 is a sectional side elevational view showing a construction of an embodiment of the invention for attaching a knob to a manipulation rod.

Referring to FIG. 3, reference numeral 1 denotes a switch body, while reference numeral 2 denotes a manipulation rod made of a synthetic resin and provided at its intermediate portion with a flange 2a. The manipulation rod 2 is further provided at its lower end with a groove 2b for receiving a driving member 3 adapted for driving the contact of the switch and, at its upper end, with a pair of resilient tongues 2c projecting slightly upwards in opposite directions.

A knob 4 made of a synthetic resin and attached to the manipulating rod 2 is provided with an inner cylinder 4a adapted to receive the end of the manipulation rod 2 and has an outer wall 4b. A snapping protrusion 4c is formed at the lower end portion of the inner peripheral surface of the outer wall 4b. The snapping protrusion 4c has a snapping step 4d and a flat surface 4e. A reference numeral 5 denotes a coiled spring which is placed between the switch body 1 and the flange 2a so as to bias the manipulating rod 2 upwardly.

Figure 4:
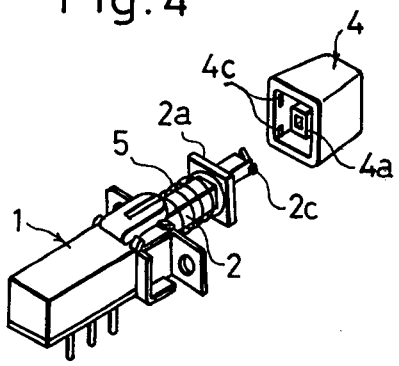
FIG. 4 is an exploded view showing assembly of the knob to the manipulation rod.
Figure 5:
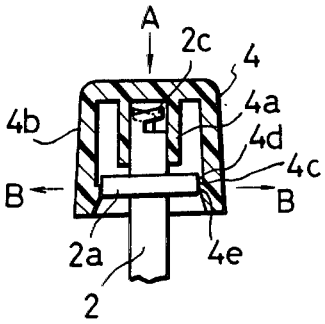
FIG. 5 is a sectional view showing the process for attaching the knob to the manipulation rod.

The knob 4 is fitted and attached to the manipulation rod 2 in a manner described hereinunder. After placing the knob 4 above the switch body 1 as shown in FIG. 4, the end of the manipulation rod 2 is fitted into the bore of the inner cylinder 4a of the knob 4 and the latter is pressed in the direction of the arrow A shown in FIG. 5. In consequence, the outer periphery of the flange 2*a* formed on the manipulation rod 2 slides into the outer wall 4*b* of the knob 4 to outwardly bias the snapping protrusion 4*c* to spread the outer wall 4*b* of the knob 4 in the direction of the arrow B by a wedging action. The outer periphery of the flange 2*a* then comes to be flush with the flat surface 4*e* of the snapping protrusion 4*c* and is slipped along the flat surface 4*c* into engagement with the snapping step 4*d*, so that the flange 2*a* and the snapping protrusion 4*c* make snapping engagement with each other to firmly fix the knob 4 to the manipulation rod 2.

According to the invention, the bottom surface of the bore of the inner cylinder 4*a* of the knob 4 resiliently presses the tongues 2*c* such that the tongues 2*c* resiliently push the bottom of the bore of the inner cylinder 4*a* of the knob 4 upward, thereby to ensure a firm and stable engagement between the flange 2*a* and the snapping protrusion 4*c* without any play.

As has been described, according to the invention, a snapping protrusion is formed on the outer wall of the knob, for snapping engagement with the manipulation knob. It is, therefore, possible to obtain a larger distance between the center of the knob and the snapping projection as compared with conventional construction in which the snapping protrusion is formed on the inner peripheral surface of the bore for receiving the manipulation rod, so that a stable snapping engagement is achieved over that of the conventional construction.

Since the snapping protrusion is provided with a flat surface, the outer periphery of the flange of the manipulation rod slides along this flat surface when the knob is attached to the rod, so that the undesirable cutting or grinding of the flange is completely eliminated. In addition, the deterioration of dimensional precision of the snapping protrusion during attaching of the knob is avoided. Since the shape and size remain unchanged, the unfavourable play or looseness of the knob is eliminated. In addition, the resilient tongues formed on the end of the manipulation rod effectively push the knob upward to maintain stable and strong engagement between the flange and the snapping protrusion, thereby to prevent the knob from dropping out of engagement with the manipulating rod.

The above-described knob of the invention having a high dimensional precision and a flat surface is formed in accordance with the following method.

Figure 6:
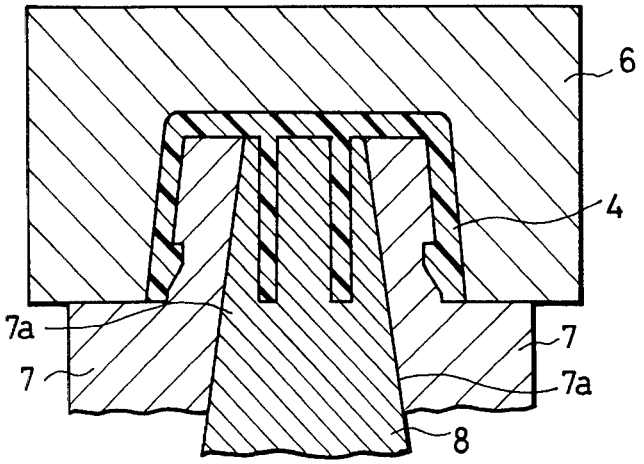
FIG. 6 is a sectional view of an apparatus for forming the knob of the invention, showing a mold cavity filled with a synthetic resin.
Figure 7:
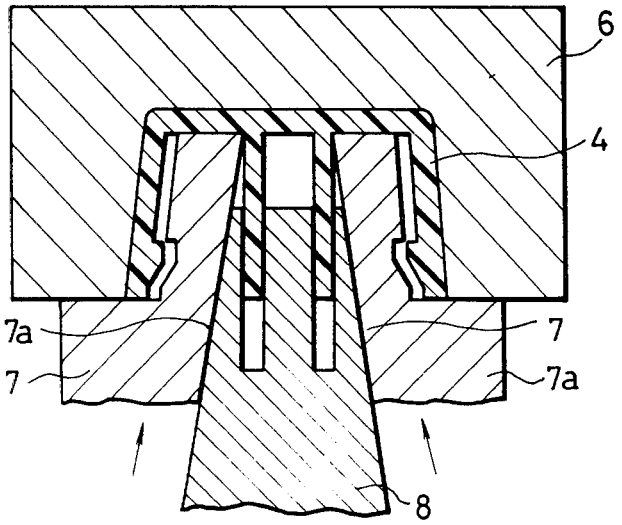
FIG. 7 is a sectional view of the apparatus shown in FIG. 6 showing the step of withdrawal of the knob from the mold.

FIG. 6 shows a mold assembly suitable for use in forming the knob of the invention. This mold assembly has an upper mold 6 having a recess conforming to the outer configuration of the knob, a pair of lower molds 7 disposed in the upper mold 6 and having a shape conforming to the inner configuration of the knob, the lower molds being provided with a tapered section 7*a* diverging downwardly, and a core 8 disposed between the lower molds 7 and 7 and making a tight contact with the tapered section 7*a*, the core 8 having a configuration conforming to the shape of the bore of the inner cylinder of the knob. The upper mold 6, lower molds 7, 7 and the core 8 in combination define a mold cavity. This mold cavity is filled with a molten plastic and the plastic is cooled and solidified as usual. Then, as shown in FIG. 7, the lower molds 7, 7 are lifted as shown by the arrows to withdraw the core 8. As the core 8 is withdrawn, the lower molds 7, 7 are moved toward the center to leave the inner surface of the outer wall of the knob, so that the snapping step and the flat surface of the snapping projection are never damaged. Thereafter, the lower molds 7, 7 are withdrawn and the knob is extracted from the upper mold 6 to complete the shaping of the knob.

What is claimed is:

1. A knob and a manipulation rod of a push-button type actuating mechanism adapted to be attached to one another, characterized in that: said manipulating rod of said push-button type actuating mechanism has a flange and a projecting portion projecting axially from said flange, said projecting portion being provided at its end portion with resilient tongues; and that said knob has a cap-like shape having an inner peripheral surface provided with a snapping step for engagement with the outer periphery of said flange, said knob further having a linner cylinder having a bore for receiving said projecting portion of said manipulating rod, said bore having a length smaller than that of said projecting portion so that said tongues are resiliently deformed when said projecting portion is received by said cylinder.

2. A device as claimed in claim 1, wherein said manipulating rod is made of a resilient plastic material, while said tongues are formed on the end of said projecting portion at an inclination to the axis of said manipulating rod.

3. A device as claimed in claim 2, wherein said snapping step having a tapered section projecting inwardly of said inner peripheral surface of said knob and adapted to guide the movement of said flange when said manipulating rod is slided into said knob, and a step portion adapted to be engaged by the outer periphery of said flange as said manipulation rod is pressed resiliently by said tongues.

* * * * *